US006746281B1

(12) United States Patent
Zhang

(10) Patent No.: US 6,746,281 B1
(45) Date of Patent: Jun. 8, 2004

(54) HIGH SPEED ELECTRICAL CONNECTOR

(75) Inventor: George Huanyi Zhang, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/678,991

(22) Filed: Oct. 2, 2003

(51) Int. Cl.[7] ..... H01R 24/00
(52) U.S. Cl. ..... 439/637
(58) Field of Search ..... 439/637, 636, 439/62, 65

(56) References Cited

U.S. PATENT DOCUMENTS 5,820,388 A * 10/1998 Walden ..... 439/62
6,099,328 A * 8/2000 Nelson et al. ..... 439/101
6,331,122 B1 12/2001 Wu
6,347,950 B1 * 2/2002 Yokoyama et al. ..... 439/248
6,358,061 B1 * 3/2002 Regnier ..... 439/60
D469,407 S 1/2003 Wu
6,558,200 B1 * 5/2003 Choy ..... 439/637
6,592,401 B1 7/2003 Gardner et al.

* cited by examiner

*Primary Examiner*—Gary Paumen
(74) *Attorney, Agent, or Firm*—Wei Te Chung

(57) ABSTRACT

An electrical connector (1) includes an elongated insulative housing (10) and a number of contacts (20). The insulative housing includes a base portion (11), a pair of opposite first and second lengthwise walls (12, 13) extending from the base portion. The first lengthwise wall has a first and a second mating sections (121, 122) and defines a recess (120) between the first and second mating sections. The second lengthwise wall has a third mating section (131) protruded from an outer face thereof. The first, the second and third mating sections each defines a number of passageways (103) extending therethrough. The contacts includes first, second and third contacts (21, 22, 23) respectively received in passageways of the first, the second and the third mating sections.

2 Claims, 7 Drawing Sheets

HIGH SPEED ELECTRICAL CONNECTOR

CROSS-REFERENCE TO RELATED APPLICATIONS

This patent application is related to a copending U.S. patent application Ser. No. 10/456,369, filed on Jun. 6, 2003 and entitled "HIGH SPEED ELECTRICAL CONNECTOR", which is assigned to the same assignee as this patent application.

BACKGROUND OF THE INVENTION

1. Field of the Invention

The present invention generally relates to an electrical connector, and particularly to a high speed Serial Attached SCSI (Small Computer System Interface) (SAS) connector mounted on a printed circuit board.

2. Description of Related Art

Parallel ATA (Advanced Technology Attachment) and parallel SCSI are two dominant disk interfaces technologies today. The parallel ATA disks are widely used in desktop PCs and mobile PCs, and the parallel SCSI disks are mainly used in high-volume servers and subsystems. As disk interconnect speeds continue to rise, existing parallel ATA and parallel SCSI buses are reaching their performance limits because that parallel transmissions are susceptible to crosstalk across multiple streams of wide ribbon cable that adds line noise and can cause signal errors—a pitfall that has been remedied by slowing the signal transmitting speed, limiting cable length or both. Therefore, new interconnect technologies are needed to meet performance requirements going forward. The serial technology is emerging as a solution to the problem. The main advantage of serial technology is that while it does move data in a single point-to-point stream, it does so much faster than parallel technology because it is not tired to a particular clock speed.

Serial ATA (SATA) is a serial version of ATA, which is expected to be a replacement for parallel ATA. U.S. Pat. No. 6,331,122 discloses a type of SATA receptacle connector for being mounted on a printed circuit board. The receptacle connector has two receiving cavities defined in an insulative housing thereof and two sets of conductive contacts respectively used for power and signal transmission installed in the insulative housing. U.S. Pat. No. D469,407 discloses an electrical connector assembly with a SATA plug connector as a part thereof. The plug connector has two generally L-shaped tongue plates receiving two sets of terminals for electrically connecting the conductive contacts as the tongue plates are inserted into the respective receiving cavities of the receptacle connector.

SAS is a successor to the parallel SCSI and is also based on serial technology. Besides the advantage of higher speed signal transmission, another most significant advantage is the SAS interface will also be compatible with SATA drives. In other words, the SATA plug connector can plug directly into an SAS receptacle connector if supported in the system. By this way, the system builders are flexible to integrate either SAS or SATA devices and slash the costs associated with supporting two separate interfaces.

The SAS receptacle connector has generally the same configuration as the SATA receptacle connector except that the two cavities of the SATA receptacle connector are merged in a large one of the SAS receptacle connector, and a third set of signal contacts are assembled to a second side wall opposing a first side wall where two sets of contacts have already being assembled. However, the second side wall is much thinner in a lateral direction of the connector than the first side wall. Thus, it is difficult to provide passageways in such second side wall like in the first side wall for receiving contacts and allowing the contact portion of each to be moveable therein. If the third sets of contacts are directly adhered on an inner face of the second side wall with each contact portion curved away from the inner face, when an SAS plug connector mates with the SAS receptacle connector, terminals of the SAS plug connector tightly abut against the corresponding contacts of the SAS receptacle connector to establish an electrical connection therebetween. However, the contact portion of each contact is inevitably deformed toward the inner face after a long term pressure of the terminal, which will reduce the normal contacting force between the contact and the terminal, thereby causing the electrical connection therebetween unreliable or even break.

Hence, an improved electrical connector is highly desired to overcome the disadvantages of the related art.

BRIEF SUMMARY OF THE INVENTION

Accordingly, it is an object of the present invention to provide an electrical connector, which can provide a reliable electrical connection with a complementary connector.

In order to achieve the above-mentioned object, an electrical connector in accordance with the present invention comprises an elongated insulative housing and a plurality of contacts. The insulative housing comprises a base portion, a pair of opposite first and second lengthwise walls extending from the base portion. The first lengthwise wall has a first and a second mating sections and defines a recess between the first and the second mating sections. The second lengthwise wall has a third mating section protruded from an outer face thereof. The first, the second and the third mating sections each defines a plurality of passageways extending therethrough. The contacts includes first, second and third contacts respectively received in the passageways of the first, the second and the third mating sections. A pair of board retention pegs extend from the base portion and each have a plurality of protrusions extending along a lengthwise direction.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
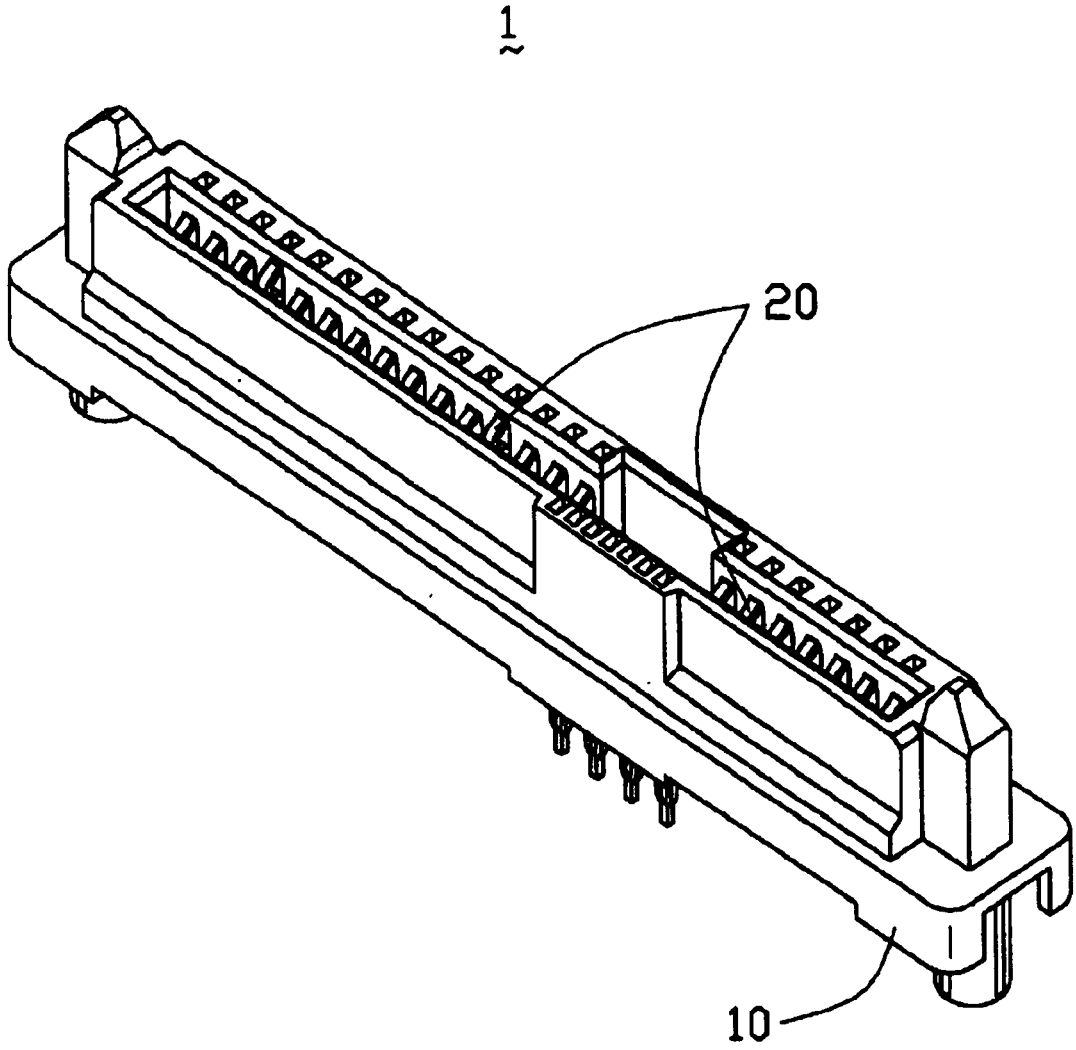
FIG. 1 is a perspective view of an electrical connector in accordance with the present invention.

Reference will now be made to the drawing figures to describe the present invention in detail.

With reference to FIGS. 1–4, an electrical connector 1 of the present invention comprises an elongated, insulative housing 10 and a plurality of contacts 20 received in the housing 10.

The elongated, insulative housing 10 comprises a longitudinal base portion 11, and a first and a second side walls 12, 13 and a pair of end walls 14, 15 extending perpendicularly from the base portion 11. A central receiving slot 16 is defmed between the longitudinally extending side walls 12, 13 and the laterally extending end walls 14, 15 for engaging with a complementary connector (not shown). The elongated, insulative housing 10 also forms a mating surface 101 and an opposite mounting surface 102. It can be easily seen from the figures that the thickness of the first side wall 12 is larger than that of the second side wall 13. The first side wall 12 has a recess 120 recessed from an inner face thereof which divides the first side wall 12 into a first mating section 121 and a second mating section 122. The first mating section 121 of the first side wall 12 is longer than the second mating section 122. The second side wall 13 has a third mating section 131 protruded from an outer face thereof at a position opposing to the recess 120 of the first side wall 12. The first, the second and the third mating sections 121, 122, 131 each define a plurality of passageways 103 extending from the mating surface 101 toward the mounting surface 102 and communicating with the central receiving slot 16. The base portion 11 of the housing 11 defines an upper row and a low of cavities 104, 105 respectively communicating with corresponding passageways 103 formed in the first and second mating sections 121, 122. The cavities 104, 105 in the two rows are staggeredly arranged with each other. A row of slits 106 are defined in the base portion 11 communicating with corresponding passageways 103 of the third mating section 131.

A pair of guiding posts 17 protrude oppositely from the base portion 11 and next to the respective end walls 14, 15. Each guiding post 17 forms a tapered guiding portion 171 extending beyond the mating surface 101 of the housing 10 for guiding an insertion of the complementary connector. A pair of board retention pegs 18 protrude from the base portion 11 and extend along a direction away from the respective guiding posts 17 for retaining the electrical connector 1 on a printed circuit board (not shown). Each board retention peg 18 has a plurality of protrusions 181 protruded along a lengthwise direction on a periphery surface thereof.

Figure 2:
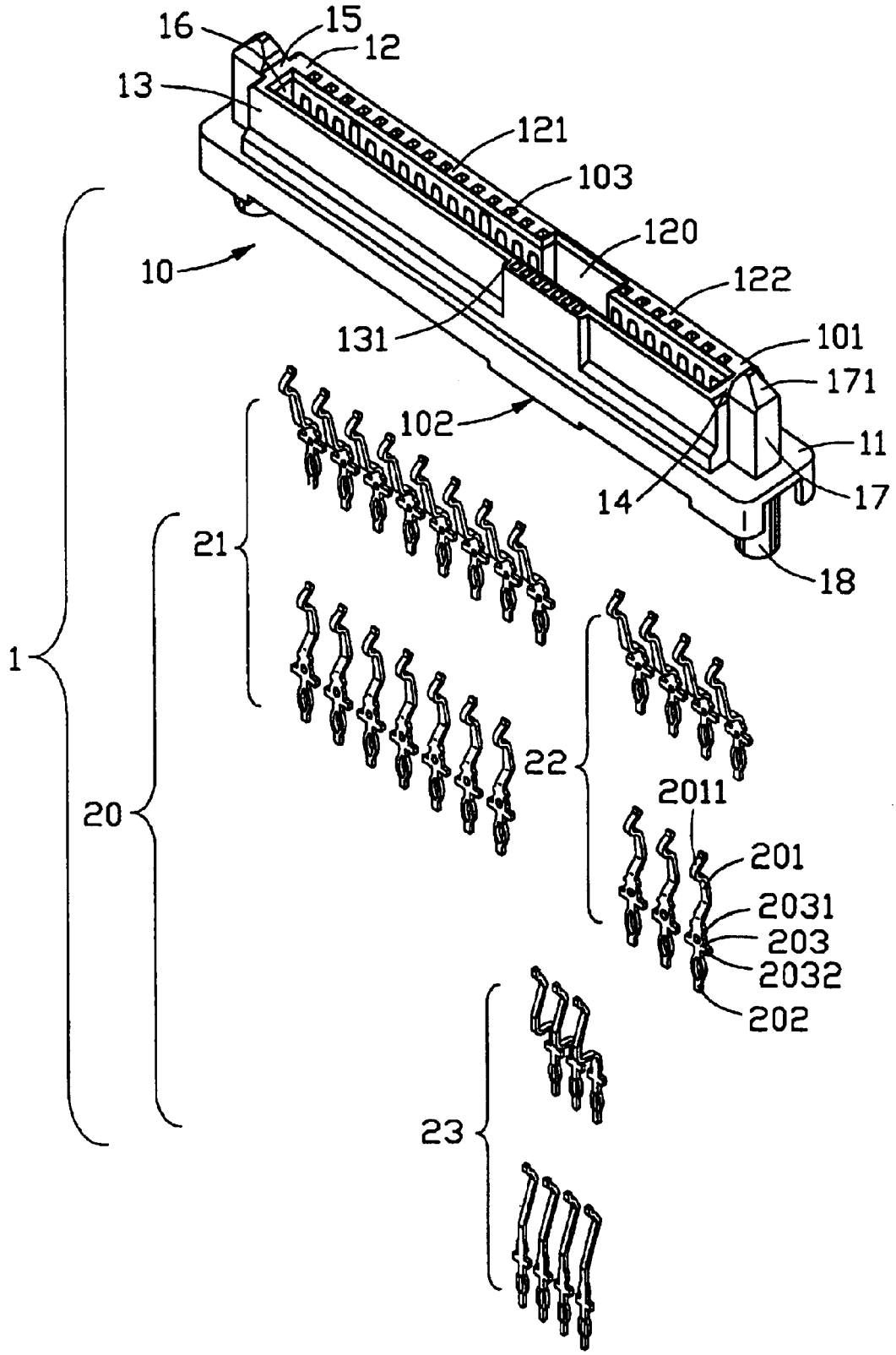
FIG. 2 is an exploded, perspective view of FIG. 1.
Figure 3:
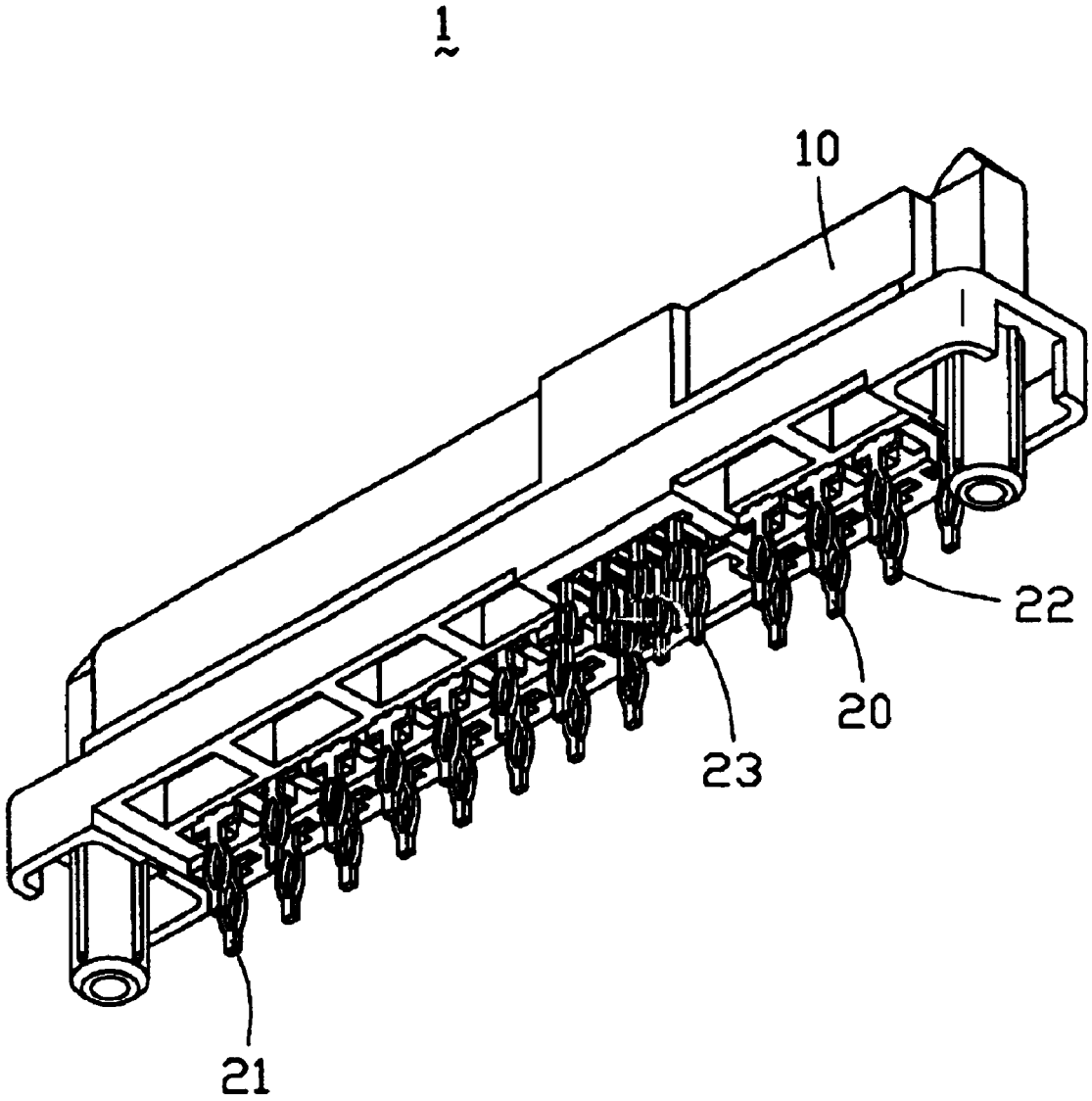
FIG. 3 is another perspective view of the electrical connector.
Figure 4:
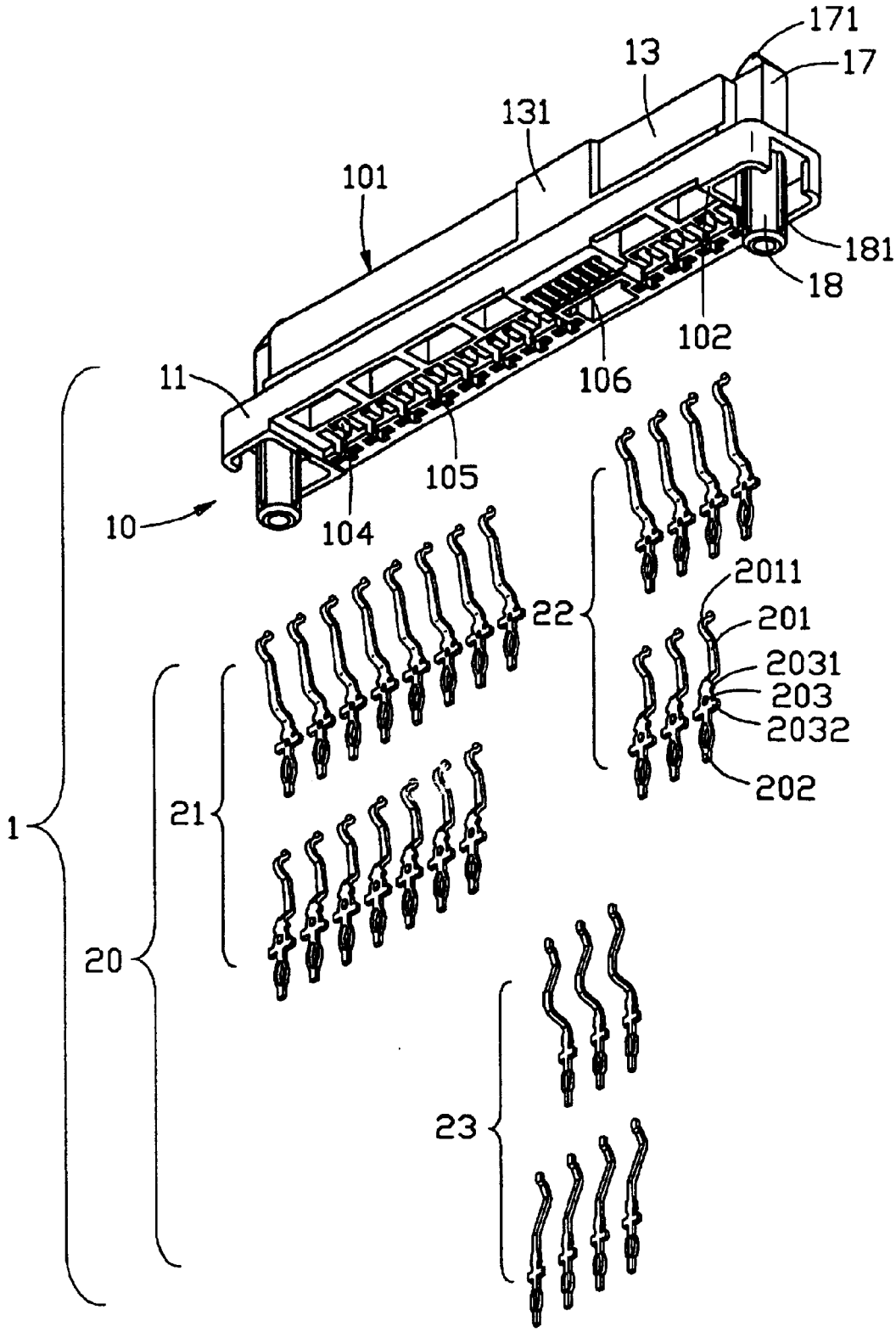
FIG. 4 is an exploded, perspective view of FIG. 3.
Figure 5:
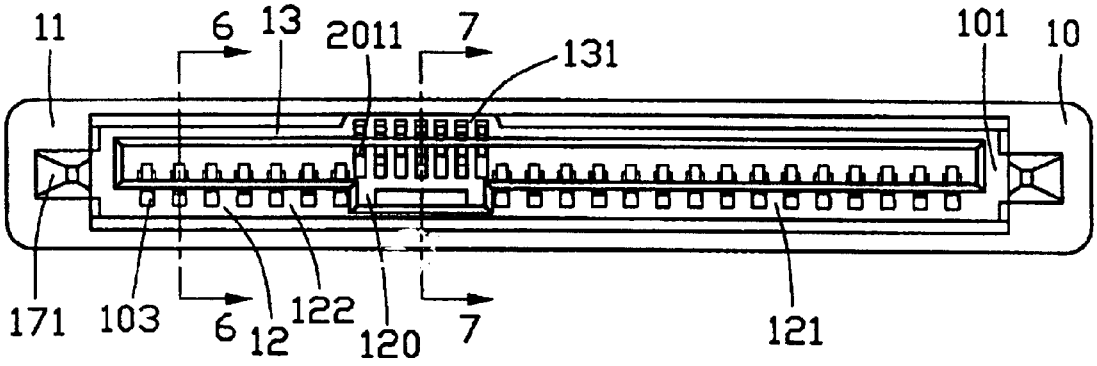
FIG. 5 is a top plan view of the electrical connector.
Figure 6:
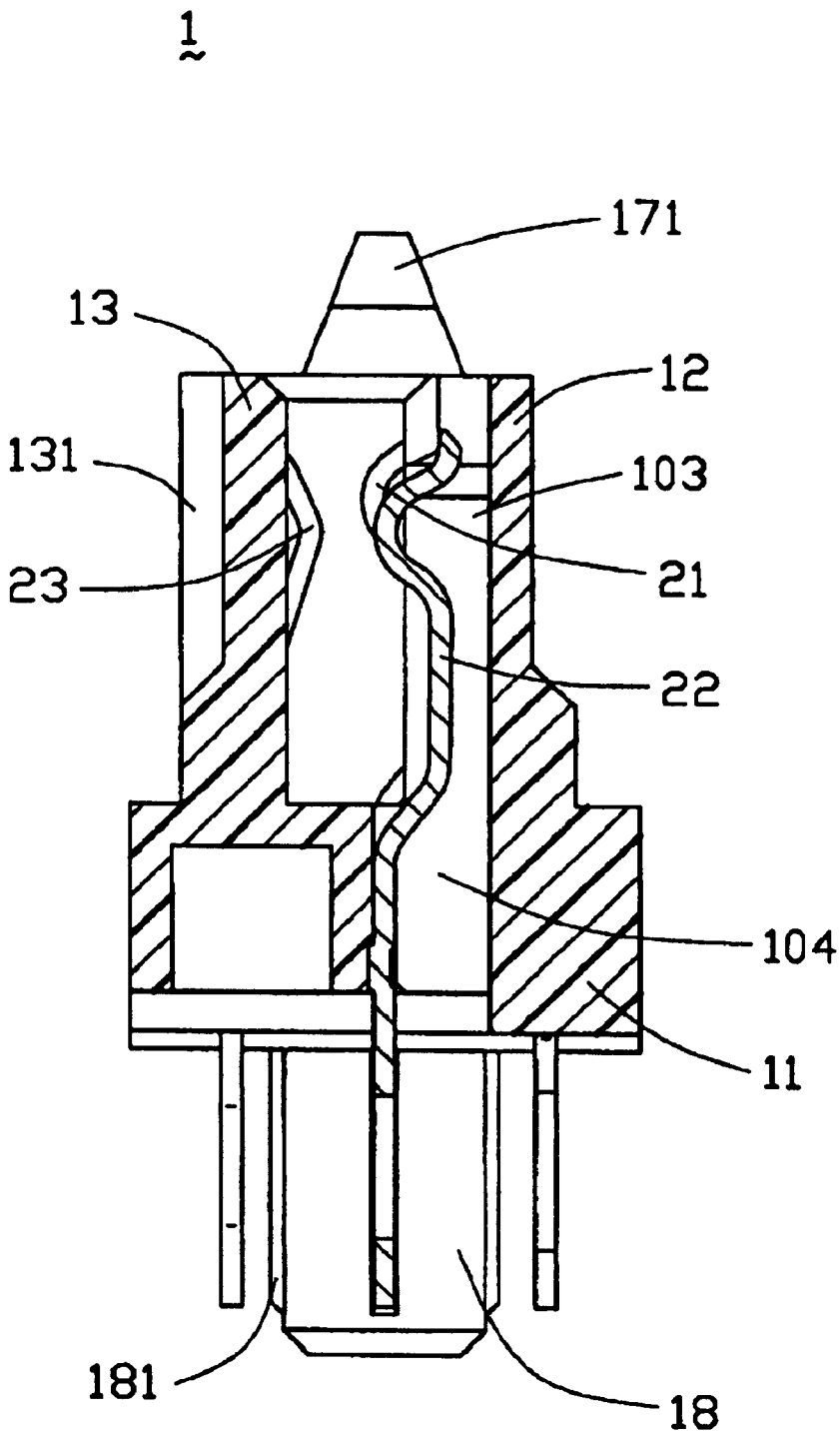
FIG. 6 is a cross-sectional view of FIG. 5 taken along line 6—6.
Figure 7:
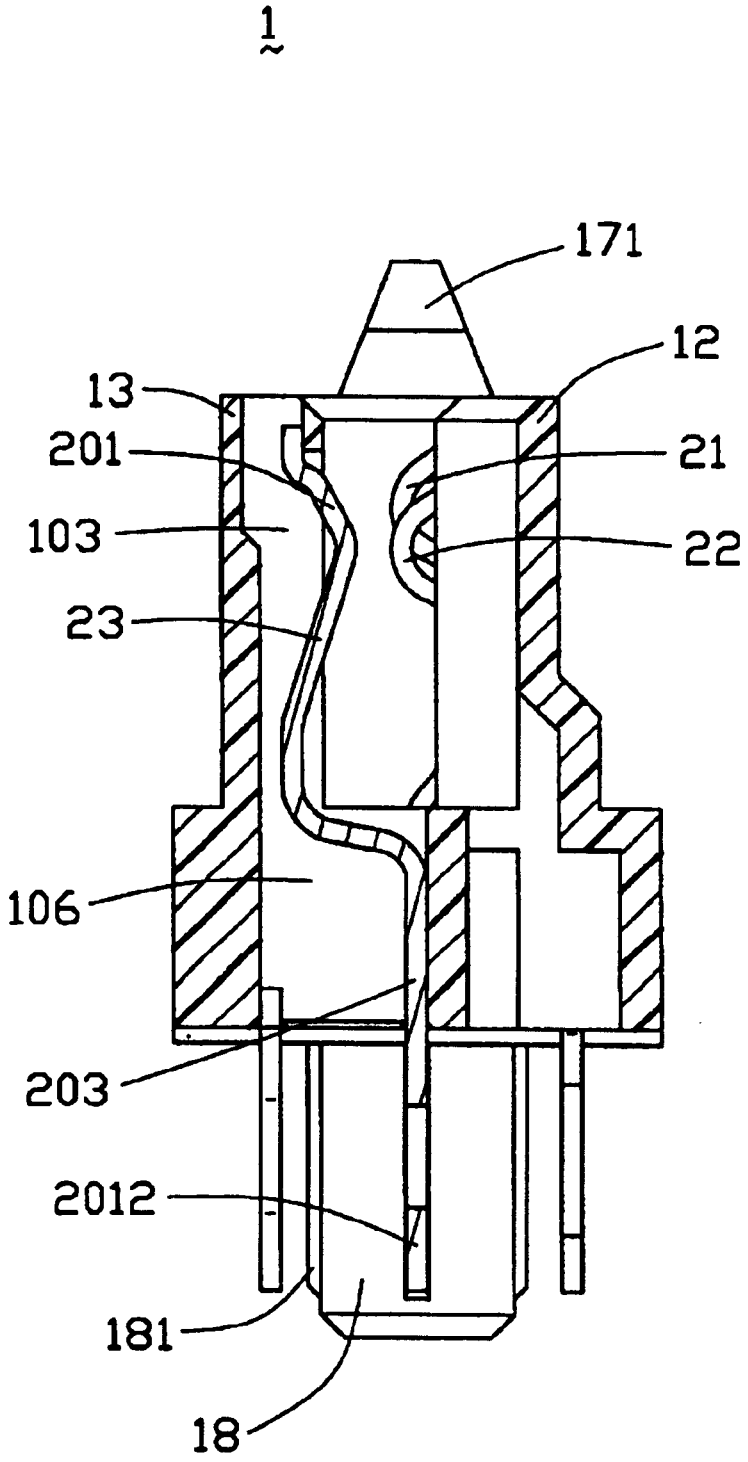
FIG. 7 is a cross-sectional view of FIG. 5 taken along line 7—7.

Turn to FIGS. 2 and 4, the contacts 20 include a set of first contacts 21 mainly for power transmission, a set of second contacts 22 and a set of third contacts 23 both for signal transmission. The first, second and third contacts 21, 22, 23 are respectively received in corresponding passageways 103 of the first, second and third mating sections 121, 122, 131. The three sets of contacts 20 are substantially identical in structure, and only one of the contacts 20 is illustrated here for simplicity. Referring to FIGS. 2 and 4 in conjunction with FIGS. 6 and 7, each contact 20 comprises a contact portion 201, a board retaining portion 202 extending oppositely to the contact portion 201, and a housing retaining portion 203 interconnecting the contact portion 201 and the board retaining portion 202. The contact portion 201 forms a convex contact end 2011 exposed in the central receiving slot 16 of the housing 10 for electrically engaging with a corresponding terminal of the complementary connector. The board retaining portion 202 is configured for press-fitting in the printed circuit board. The housing retaining portion 203 provides a barb 2031 on a lateral edge for interfering within the housing 10, and a pair of oppositely projecting arms 32.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector for mounting on a printed circuit board, comprising:

an elongated insulative housing defining an uninterrupted central slot along a lengthwise direction thereof, the housing comprising a base portion and opposite first and second lengthwise walls extending from the base portion and being located at opposite longitudinal sides of the central slot, the first lengthwise wall having a first mating section, a second mating section and a recess defined between the first and second mating sections, the second lengthwise wall having a third mating section in alignment with the recess of the first lengthwise wall, each mating section defining a plurality of passageways extending therethrough; and a plurality of contacts received in the housing;

wherein the thickness of the first lengthwise wall is larger than that of the second lengthwise wall;

wherein the third mating section of the second lengthwise wall protrudes outwardly from an outer face thereof;

wherein the first mating section has a longitudinal dimension larger than that of the second mating section;

wherein the contacts comprise first contacts received in the first mating section for transmitting power, second and third contacts respectively received in the second and the third mating sections for transmitting signals;

wherein the contacts are substantially identical in structure and each contact comprises a contact portion with a curved contact end exposed in the central slot of the housing, a board retention portion extending outwardly from the housing, and a housing retention portion connecting the contact portion and the board retention portion;

wherein the board retention portions of the first contacts the second contacts and the third contacts are arranged in two rows, respectively;

wherein the board retention portions of the contacts are configured for press-fitting in holes of the printed circuit board;

wherein the base portion of the housing defines upper and lower rows of cavities communicating with respective passageways defined in the first and second mating sections and a row of slits communicating with respective passageways defined in the third mating section, and wherein the housing retention portions of the first and second contacts are retained in the cavities and the housing retention portions of the third contacts are retained in the slits;

wherein the upper and lower rows of cavities are staggeredly arranged with each other;

further comprising a pair of guiding posts protruding from the base portion and a pair of board retention pegs protruding from the base portion and extending along a direction away from the guiding posts;

wherein the board retention pegs each have a plurality of protrusions extending along a lengthwise direction on a periphery surface thereof;

wherein said base portion defines a transverse dimension which is larger than another transverse dimension which is defined by said first and second lengthwise walls commonly.

2. An electrical connector comprising:

a rectangular base portion including a long longitudinal dimension along a longitudinal direction, and a small transverse dimension along a transverse direction perpendicular to said longitudinal direction;

opposite first and second elongated side walls formed upwardly from said base portion along and extending along said longitudinal direction; and a plurality of first contacts disposed in the first side wall, and a plurality of second contacts disposed in the second side wall and offset from said first contacts along said longitudinal direction; wherein an interior surface of said second side wall keeps planar while that of the first side wall defines a recess in alignment with said second contacts in the transverse direction;

wherein said longitudinal dimension and said transverse dimension commonly define a smooth and uninterrupted rectangular periphery of the base portion with a complete linear edge on each side of said rectangular periphery, wherein the transverse dimension of the base portion is larger than another transverse dimension which is defined by said opposite first and second side walls commonly;

wherein said second side wall is thinned except a portion thereof receiving the second contacts;

wherein said second side wall defines a lower portion adjoining the base portion, said lower portion being thicker than other thinned portions.

* * * * *